US006692592B2

(12) United States Patent
Kidani et al.

(10) Patent No.: US 6,692,592 B2
(45) Date of Patent: Feb. 17, 2004

(54) METHOD FOR MANUFACTURING HIGH CHROMIUM SYSTEM SEAMLESS STEEL PIPE

(75) Inventors: Shigeru Kidani, Kainan (JP); Koichi Ikeda, Wakayama (JP); Toshiharu Abe, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/361,555

(22) Filed: Feb. 11, 2003

(65) Prior Publication Data

US 2003/0127162 A1 Jul. 10, 2003

Related U.S. Application Data

(63) Continuation of application No. PCT/JP02/06256, filed on Jun. 21, 2002.

(30) Foreign Application Priority Data

Jun. 21, 2001 (JP) ..... 2001-187862

(51) Int. Cl.[7] ..... C21D 8/10
(52) U.S. Cl. ..... 148/592; 148/593
(58) Field of Search ..... 148/592, 593, 148/909

(56) References Cited

FOREIGN PATENT DOCUMENTS

| | | |
|---|---|---|
| JP | 60-187426 | 9/1985 |
| JP | 02-077519 | 3/1990 |
| JP | 04-224659 | 8/1992 |
| JP | 06-306466 | 11/1994 |
| JP | 08-120336 | 5/1996 |
| JP | 08-232018 | 9/1996 |

*Primary Examiner*—Deborah Yee
(74) *Attorney, Agent, or Firm*—Clark & Brody

(57) ABSTRACT

A method for manufacturing a high Cr system seamless steel pipe having a high inside surface quality with a high efficiency and at a reduced production cost is provided. An initial material including Cr at a content of 10 to 20%, and impurities S and P at respective contents of not more than 0.050% is used to form a finished pipe, and when using parameters, the total soaking period Σt1 (hours) for soaking the initial material to form a primary pipe material as a billet or bloom and the total soaking period Σt2 (hours) for soaking the primary pipe material, a finished pipe is formed at a heating temperature of 1,200° C. under the condition that the following equation (b) is satisfied:

$$F = f + 0.6 \times \left(1 - \frac{1}{e^{\Sigma t1}}\right) + 0.8 \times \left(1 - \frac{1}{e^{\Sigma t2}}\right) > -9.7 \quad \text{(b)}$$

where f is a factor indicating the degree of generating the δ ferrites in accordance with the contents of elements included therein. The method allows a high Cr system seamless steel pipe having a very small amount of inside surface defects to be formed, using a high Cr steel. Since a predetermined productivity can be attained without any excessive addition of impurities, a high Cr system seamless steel pipe having a high inside surface quality can be produced with a high efficiency.

2 Claims, 1 Drawing Sheet

METHOD FOR MANUFACTURING HIGH CHROMIUM SYSTEM SEAMLESS STEEL PIPE

This application is a continuation of International Patent Application No. PCT/JP02/06256, filed Jun. 21, 2002. This PCT application was not in English as published under PCT Article 21(2).

TECHNICAL FIELD

The present invention relates to a method for manufacturing a high Cr system seamless steel pipe, which is preferably employed as a structural material for constructing an oil well, a gas well, one of various plants or the like, and more specifically to a method for manufacturing a high Cr system seamless pipe, which ensures a reduced rate of generating the inside surface defects thereof, even if a seamless pipe is manufactured from a primary material (billet) for producing the pipe, which includes a Cr content of 10 to 20%.

BACKGROUND ART

Conventionally, a so-called high Cr system seamless steel pipe, which includes a Cr content of 10 to 20%, has been widely employed as a structural material for constructing an oil well, one of various plants or the like. Such a seamless steel pipe is produced in the following steps: Firstly, a hollow primary pipe is formed from a round bloom with the Mannesmann piercing process, the press piercing process or the like, and secondly, using a stretching mill, such as a mandrel mill, plug mill or the like, the hollow primary pipe is further shaped to increase the diameter thereof and at the same time to reduce the wall thickness thereof, and thereafter further shaped to form a finished pipe having a desired size, using a reducing mill, such as a stretch reducer.

In the case of manufacturing the above-mentioned high Cr system seamless steel pipe, a round billet, which is produced by rolling an ingot manufactured by the continuous casting process or the ingot blooming process, is used as a primary material (billet) for producing the pipe. Typically, the billet used as such a primary material is manufactured in the following steps: An ingot (bloom) having a rectangular cross section is formed by the continuous casting process or the ingot blooming process, and, after uniformly heated over a wide area at a predetermined temperature, the bloom is either hot-rolled into a round shape with a stabbing mill, blooming mill, or the like, or continuously cast into a round bloom.

The high Cr steel is normally inferior to the conventional steels, regarding the hot workability and therefore defects often generate on the inside surface of the steel pipe after the pipe is produced. When, for instance, defects such as inside small scabs (hereinafter referred to as "the inside surface defects") are generated on the inside surface of the steel pipe, not only the yield in the production of the pipes is decreased, but also the mill train including a stretching mill and a reducing mill, along with a piercing mill, has to be stopped. Accordingly, the productive efficiency in the total system is greatly reduced.

In order to avoid the generation of such inside surface defects in the production of seamless steal pipes with the hot working, several means have been usually employed, in which, for instance, either the degree of working in the course of producing the pipes is reduced or the temperature at which the primary material is processed is decreased to reduce the number of defects generated by heating due to the working. However, the above-mentioned means cause the productive efficiency in producing the pipes with the hot working to decrease, and therefore it cannot be stated that these means are appropriate for suppressing the inside surface defects.

In Japanese Patent Application Laid-open No. 04-224659, for instance, a method for manufacturing a martensitic seamless steel pipe is proposed, in which the texture may be improved in the hot working by the contents of several alloy elements within certain ranges, and by controlling the period of annealing, together with the usage of a relative low temperature of not more than 1,200° C. in the piercing treatment. In this method, however, the type of steels applicable thereto is restricted because the control of the specified elements in the alloy is severe, and at the same time, the restriction of the upper limit in the heating temperature for forming the pipe with the piercing process provides not only a reduction in the productive efficiency of the pipe as well as in the productivity of the total system, but also a decrease in the service time of tools used for manufacturing the pipe.

DISCLOSURE OF INVENTION

As described above, the conventional means for suppressing the inside surface defects, which means is employed in the manufacturing the pipe using such a hard-workable material as high Cr steel or the like, have required a reduction in the degree of working as well as in the heating temperature. This inevitably has provided a reduction in the productivity for manufacturing the pipe, thereby making it difficult to enhance the productive efficiency of the total system.

Taking into account these problems in the prior art, it is an object of the present invention to provide a method for manufacturing a seamless steel pipe of a high Cr system, which method ensures to effectively prevents the inside surface defects from generating without any reduction in the productivity, when manufacturing a seamless steel pipe from a bloom or billet of a high Cr steel system as a primary material for producing the pipe.

The generation of the inside surface defects in manufacturing a high Cr system seamless steel pipe results from the crack generation at fragile parts of the texture due to the stress in the work of producing the pipe, and from the further development of the cracks to the inside surface defects, because the hot workability of such a steel is inferior. The fragile parts in a hot-worked high Cr steel are grain boundaries between austenite $\gamma$ particles and $\delta$ particles, where the austenite $\gamma$ particle is one of the main textures at a high temperature of the steel and the $\delta$ particle is included at a very small amount together with the generation of $\delta$ ferrites.

Accordingly, in order to reduce the inside surface defects generated in the hot working, [1] it is necessary to reduce the fragile parts in the textures by decreasing the number of the generated $\delta$ ferrites, and [2] it is necessary to increase the mechanical strength of each grain boundary between an austenite $\gamma$ particle and a $\delta$ particle. As the first means [1], the reduction of the amount of the impurity elements (S and P), which make the grain boundaries fragile, is effective, but an excessive reduction causes the manufacturing cost to increase. On the other hand, the method proposed by the above-mentioned Japanese Patent Application Laid-open No. 04-224659 is effective as the second means [2]. However, in order to enhance the productive efficiency in manufacturing the seamless steel pipe, a further improvement is required to the practical applications.

After detailed investigations, the present inventors have found that the degree of influence of alloy elements and Cr contained on the generation of δ ferrites can be quantitatively expressed and the degree of the influence of the thermal history in the stage of manufacturing the billet and in the pre-stage of manufacturing the pipe from the primary material on the amount of δ ferrites generated can also be quantitatively expressed.

By further applying the obtained results to the actual production lines, the present inventors have found that an inexpensive seamless steel pipe having an excellent inside surface quality can be produced with a high productive efficiency, even if the amount of impurity elements (S and P) is excessively reduced, and even if the pipe manufacturing conditions are further moderated.

The present invention is accomplished on the basis of the above-described findings, and thus provides the following two methods (1) and (2) for producing a high Cr system seamless steel pipe:

(1) A method for manufacturing a high Cr system seamless steel pipe, wherein an initial material including Cr at a content of 10 to 20 mass %, impurities S and P at respective contents of not more than 0.050 mass %, and one or more of C, Mn, Ni, N, Cu, Si, Mo, Ti, Nb and V is heated for soaking at a temperature of not less than 1,100° C. for a total soaking period Σt1 (hours) to form a primary pipe material as a billet or bloom, and thereafter the primary pipe material is further heated for soaking at a temperature of not less than 1,100° C. for a total soaking period Σt2 (hours) and then heated at a temperature of 1,200° C. to form a finished pipe, wherein the soaking and/or the heating is carried out so as to fulfill the following equation (b), $$f=\{20\times C+0.3\times Mn+1.2\times Ni+25\times N+Cu-9\times Si-0.8\times Cr-2\times Mo-10\times Ti-6\times Nb-15\times V\}-45\times(S+P/10) \quad (a)$$

$$F=f+0.6\times\left(1-\frac{1}{e^{\Sigma t1}}\right)+0.8\times\left(1-\frac{1}{e^{\Sigma t2}}\right)>-9.7 \quad (b)$$

where element symbols in the equation (a) represent the contents of the corresponding elements (mass %).

(2) A method for manufacturing a high Cr system seamless steel pipe, wherein an initial material including Cr at a content of 10 to 20 mass %, impurities S and P at respective contents of not more than 0.050 mass %, and one or more of C, Mn, Ni, N, Cu, Si, Mo, Ti, Nb and V is heated for soaking at a temperature of not less than 1,100° C. for a total soaking period Σt1 (hours) to form a primary pipe material as a billet or bloom, and thereafter the primary pipe material is further heated for soaking at a temperature of not less than 1,100° C. for a total soaking period Σt2 (hours), and thereafter, the primary pipe is heated at a temperature of 1,100 to 1,300° C. (except for 1,200° C.) to form a finished pipe, wherein the soaking and/or the heating is carried out so as to fulfill the following equation (c), $$F=f+0.6\times\left(1-\frac{1}{e^{\Sigma t1}}\right)+0.8\times\left(1-\frac{1}{e^{\Sigma t2}}\right)+1.4\times KT>-9.7 \quad (c)$$

where $$KT=\frac{1200-T}{\sqrt{|1200-T|}}.$$

BEST MODE FOR CARRYING OUT THE INVENTION

Figure 1:
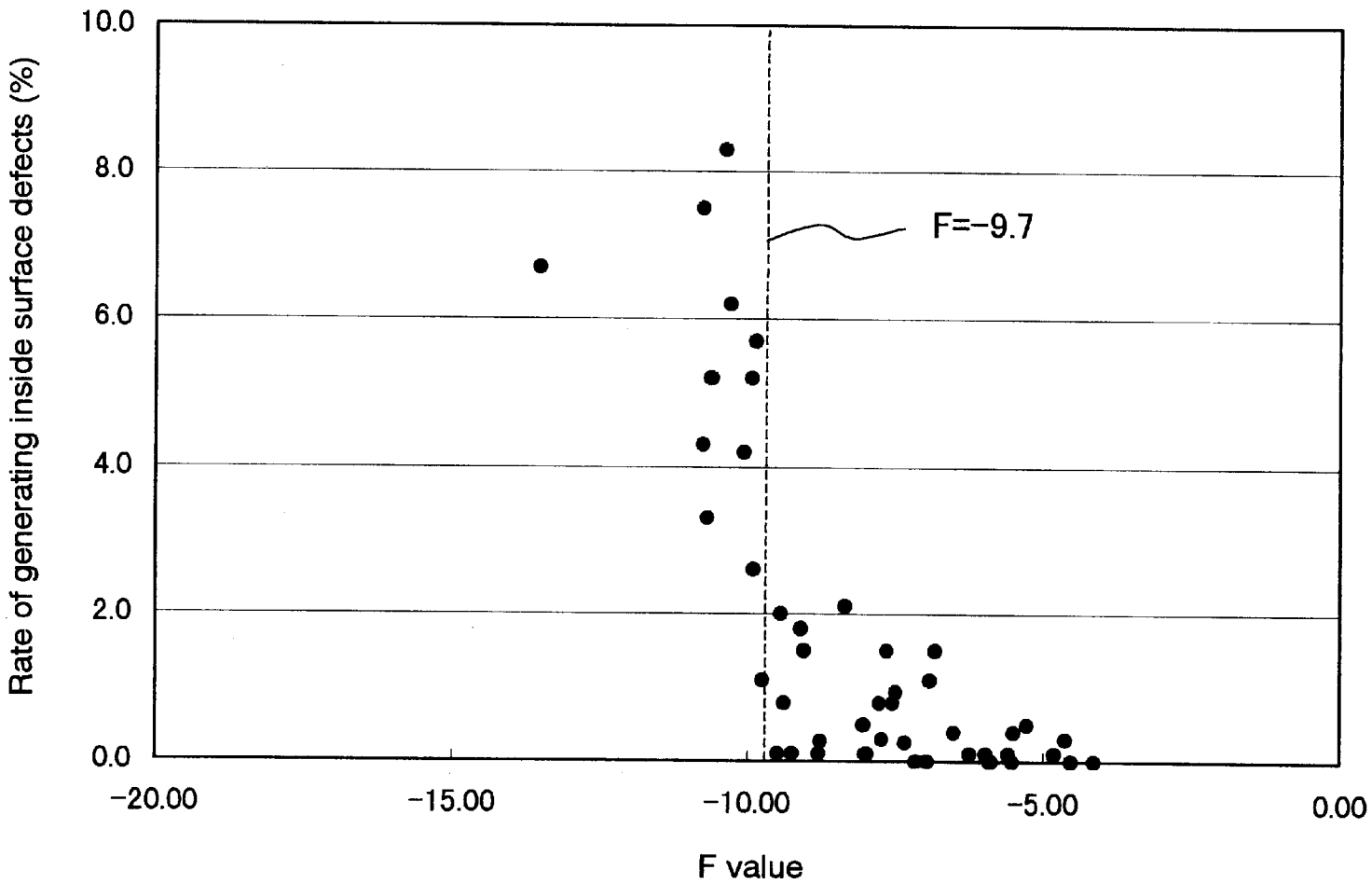
FIG. 1 is a diagram showing the relationship between the F value for a high Cr system seamless steel pipe and the rate of occurring the inside surface defects (%) in the embodiment.

In the method according to the invention, it is assumed that an initial material for producing the pipe has a Cr content of 10 to 20% in mass % and the impurity contents of S and P are not more than 0.050%, respectively. In the following description, "%" means "mass %".

Cr is an element requisite for enhancing the corrosion resistance, and for instance, a desired corrosion resistance for $CO_2$ cannot be attained, if its content is less than 10%. When, however, the Cr content is greater than 20%, the δ ferrite phase tends to generate at a high temperature, and the corrosion resistance (sulfide stress corrosion resistance) and the hot workability are reduced. In addition, an excessive addition of Cr causes an increased in the manufacturing cost.

P is inevitably present as an impurity element in any steel, but it is preferable that it contained at as a low content as possible. If the content is greater than 0.050%, the brittleness of the high strength material is deteriorated, together with a significant reduction in the mechanical strength of ferrite/γ particle boundaries as well as in the hot workability. As a result, it is preferable that the P content should be not more than 0.050%.

S is inevitably present as an impurity element in any steel. Since it provides undesirable influence on the hot workability, it is preferable that its content is as small as possible. If the content becomes to be greater than 0.050%, the mechanical strength of ferrite/γ particle boundaries and the hot workability are greatly decreased. As a result, it is preferable that the S content should be not more than 0.050%. However, an appropriate content of S is effective for attaining both the machining property and the welding property of the steel, and therefore it is preferable that the S content is set to be not less than 0.004% in order to obtain such effects.

In accordance with the present invention, only the Cr content and the S and P contents are exclusively specified for the chemical components of the pipe material. However, the other elements contained in a high Cr steel, such as 13% Cr steel, SUS 304 steel, SUS 316 steel, SUS 321 steel and SUS 347 steel, may be included.

In order to obtain the mechanical strength, toughness and corrosion resistance and the like, while suppressing the generation of δ ferrites, one or more of the following groups can be included: C: not more than 0.30%, Si: not more than 1.00%, Mn: not more than 2.0%, Mo: not more than 3.00%, Cu: not more than 0.50%, Ni: not more than 11.00%, Ti: not more than 0.200%, Al: not more than 0.100%, N: not more than 0.150%, B: not more than 0.0050%, Nb: not more than 0.150%, V: not more than 0.20% and Ca: not more than 0.0050%. In the following, the function and effect of these elements will be described.

C is normally added to enhance the mechanical strength of the steel material. However, an excessive addition provides the formation of Cr carbides ($Cr_{23}C_6$ and the like), thereby causing the corrosion resistance and the low temperature toughness of the steel material to decrease. As a result, the upper limit of the C content should preferably be 0.30%.

Si is added as a deoxidizer in the steel manufacturing process. However, an excessive addition deteriorates the toughness. Accordingly, it is preferable that the Si content should be not more than 1.00%.

Mn enhances the hardening property of the steel, so that it is effective to obtain the mechanical strength of the steel material. Moreover, Mn suppresses the generation of δ ferrites influencing on the hot workability, and further provides the effect of immobilizing S in the steel. However, an excessive addition also deteriorates the toughness. Accordingly, it is preferable that the Mn content should be not more than 2.0%.

Mo plays an essential role on strengthening the corrosion-proof coating in an environment containing carbon dioxide and sulfureted hydrogen. Accordingly, an increased Mo content greatly improves the corrosion resistance. Nevertheless, the addition of Mo tends to generate the δ ferrites, so that an increased amount of elements suppressing the generation of austenite has to be added, thereby causing the cost of producing the steel material to increase. Accordingly, it is preferable that the upper limit of the Mo content should be 3.00%.

Cu serves as an element for generating the austenite and therefore suppresses the generation of δ ferrites. Accordingly, Cu is effective for stabilizing the texture. However, an excessive addition reduces the ductility when the steel material is used during a long term at a high temperature. Accordingly, it is preferable that the Cu content should be not more than 0.50%.

Ni serves as an element for generating the austenite and therefore suppresses the generation of δ ferrites. Hence, Ni is effective for stabilizing the texture, and at the same time, for obtaining the necessary mechanical strength, the enhanced corrosion resistance and the improved hot workability. An excessive addition provides the saturation in the above-mentioned effects, thus causing the production cost to increase. Moreover, an increased amount of Ni reduces the ductility when the steel material is used at a high temperature. Accordingly, it is preferable that the Ni content should be not more than 11.00%.

Ti is an element effective for improving the corrosion resistance as well as for enhancing the mechanical strength and the toughness. However, the Ti content of more than 0.200% reduces the toughness.

Al is an element, which is added to the steel as a deoxidizer. However, an excessive addition deteriorates the index of cleanliness of steel and reduces the workability together with a reduction in the mechanical strength at a high temperature. Accordingly, it is preferable that the Al content should be not more than 0.100%.

N is effective for obtaining the mechanical strength of the steel. However, an excessive addition reduces the toughness. Accordingly, it is preferable that the N content should be not more than 0.150%.

B enhances the mechanical strength of the steel and simultaneously contributes to the generation of finer textures, so that it is effective for improving the toughness and corrosion resistance. However, an excessive addition deteriorates the toughness and the corrosion resistance. Accordingly, it is preferable that the B content should be not more than 0.0050%.

Nb contributes to the formation of fine carbides or fine nitrides in the steel, and therefore it is an element effective for enhancing the creep strength. However, an excessive addition provides the formation of coarse carbides, hence causing the toughness to be reduced. Accordingly, it is preferable that the Nb content should be not more than 0.150%.

V contributes to the formation of fine carbides or fine nitrides in the steel, and therefore it is an element effective for enhancing the mechanical strength, the toughness and the creep strength. However, an excessive addition provides the formation of coarse carbides, hence causing the toughness to be reduced. Accordingly, it is preferable that the V content should be not more than 0.20%.

Ca is an element effective for improving the shape of sulfides in the steel to enhance the hot workability. However, an excessive addition deteriorates the toughness and the corrosion resistance. Accordingly, it is preferable that the Ca content should be not more than 0.0050%.

In accordance with the present invention, the primary material, i.e., the billet for manufacturing the steel pipe is a 13% Cr steel, and when the Ni content is not more than 1.5% and further when the Mo content is not more than 1.0%, it is preferable that F value given by the equation (b) described below is less than −9.4 under the condition of no addition of Cu (for example, the Cu content being less than 0.2%). The specified condition results from the following facts: Cu is an element for generating the austenite and it is a low melting point metal, thereby causing the hot workability in grain boundaries to be reduced. When, moreover, the Ni content decreases and the δ ferrite phase tends to occur, the number of γ (austenite)/δ boundaries increases and thereby the inside surface defects are increasingly generated.

As described above, in the manufacturing method according to the present invention, the Cr content is specified and the contents of S and P are further specified in order to suppress the generation of the δ ferrites. However, it is assumed that several elements other than those described above can be added as elements necessary for the high Cr steel to the steel material according to the present invention. In this case, the process is controlled by the condition, which is defined by the below equation (b) or (c), taking into account the f value determined by the following equation (a):

$$f=\{20\times C+0.3\times Mn+1.2\times Ni+25\times N+Cu-9\times Si-0.8\times Cr-2\times Mo-10\times Ti-6\times Nb-15\times V\}-45\times(S+P/10) \quad (a)$$

The δ ferrite described herein is referred to either as a ferrite precipitated during the solidification or as a ferrite generated in the heating at a high temperature. The f value defined by the above equation (a) is an index representative of generating the δ ferrites with an occurring frequency in accordance with the f value. In the equation (a), the elements of generating the austenite provide a positive contributes to the f value, i.e., "+", whereas the elements of generating the ferrite provide a negative contribution to the f value, i.e., "−". The degree of tendency to generate δ ferrites in the hot working at a higher heating temperature (1,000 to 1,300° C.) can be represented by the product of the influence coefficient and the content of the respective composition elements. In other words, the f value can be recognized as a measure of the degree of generating the austenite phase.

In the manufacturing process according to the present invention, the conventional process for manufacturing a seamless steel pipe can be employed wherein a hollow primary pipe is formed from a round billet with the aid of the Mannesmann's piercing process, press piercing process or the like and then stretch-rolled to form a finished steel pipe with the reducing mill, as described above.

Usually, the Mannesmann mandrel mill or the Mannesmann plug mill is advantageously employed from the viewpoint of a high accuracy in the size and a high productivity. In the former case, a primary pipe material, i.e., a billet, which is produced by means of the continuous casting, is heated at 1,100 to 1,300° C., and then pierce-rolled with the aid of a piercer to form a hollow primary pipe. Thereafter, the primary pipe is further stretch-rolled with a mandrel mill to form a finished roll pipe, and finally form a seamless pipe having a predetermined size, passing through a stretch reducer or a sizer, in the state of the stretch rolling the finished roll pipe or after re-heating it up to a temperature of 850 to 1,100° C.

The generation of ferrite texture in the process of manufacturing the pipe depends on the thermal history of the steel pipe manufactured. In fact, if the soaking period at a high temperature (not less than 1,100° C.) is greater at the stage of rolling the ingot or bloom, or at the stage of treating the billet, the segregation is diffused into the material area, so that the generation of δ ferrites is suppressed. When the total period of heating the ingot and the bloom for soaking at a temperature of not less than 1,100° C. is denoted by Σt1 (hours) and similarly the total period of heating the primary material, i.e., the billet, for soaking is denoted by Σt2 (hours), it is necessary to monitor the two quantities in the process of manufacturing the steel pipe. The soaking time at the stage of the ingot or the bloom is regarded as a period during which the steel material is heated for soaking in a heating furnace or a soaking furnace at a temperature of not less than 1,100° C. during the rolling process in a slabbing mill. The soaking time in the case of one-heat rolling is the time during which one bloom is heating for soaking, and the soaking time in the case of two-heat rolling is the sum of the time during which one bloom is heated for soaking and the time during which one bloom is heated for soaking.

In the present invention, the soaking process at a temperature of not less than 1,100° C. is intended to increase the diffusion speed in the segregation, and the soaking at such a high temperature of 1,100° C. for long period permits eliminating the localization of the P and S impurities at a high concentration inside the material. Although there is no need for specifying the upper limit temperature for the soaking process, the soaking temperature of 1,100 to 1,300° C. is usually employed.

The heating temperature in the manufacture of the pipe influences on the generation of δ ferrites, and a decrease in the heating temperature T causes to suppress the generation of the ferrites. The heating temperature T described herein is the temperature at which the material is pierce rolled in a piercer, and it can be regarded at the temperature at which the primary material (billet) leaves the furnace after heated at a temperature of 1,100 to 1,300° C.

The above technical concept of the present invention is quantitatively expressed by the below equation (b), wherein the F value is introduced in order to evaluate the effect of the soaking period at the stage of processing the ingot and bloom, the effect of the soaking period at the stage of processing the primary material, i.e., billet, and further the effect of the heating temperature in the course of manufacturing the pipe, based on the knowledge of the diffusion effect of the segregation of impurities (S and P).

The below equation (b) means that F=f+1.4 when the soaking periods (Σt1 and Σt2) are set to be theoretically sufficiently so large as the segregation disappears due to the effect of soaking. Moreover, the degree of occurring the austenite phase is indicated as "+1.4". In this case, tending to approach the above process provides a larger degree of segregation, so that the margin of improving the segregation due to the soaking effect is decreased, thereby the above value "+1.4" is divided by "0.6" where the soaking effect in the bloom rolling process (for ingot and bloom) prevails and "0.8" where the soaking effect in the manufacturing process (billet) prevails.

Thus, the margin of improving the segregation due to the soaking period depends on the type of the process, i.e., whether it is the process of rolling bloom or the process of manufacturing the pipe. In any of these processes, if the margin of improving the segregation is approximately expressed by an exponential function of the soaking period, an expression can be obtained by the margin of improving the segregation =1−1/e(time t).

Hence, the generation of inside surface defects can securely be suppressed in manufacturing a seamless steel pipe, if the following equation (b) is satisfied during the period of processing:

$$F = f + 0.6 \times \left(1 - \frac{1}{e^{\Sigma t1}}\right) + 0.8 \times \left(1 - \frac{1}{e^{\Sigma t2}}\right) > -9.7 \qquad \text{(b)}$$

The above equation (b) indicates a condition that the pipe is manufactured at a heating temperature T of 1,200° C. When, however, the heating temperature T is different from 1,200° C., it is necessary to add a correction factor KT expressed by the following equation (c') to the equation (b):

$$KT = \frac{1200 - T}{\sqrt{|1200 - T|}} \qquad \text{(c')}$$

where the correction factor is determined by using the parabolic rule, taking a possible negative value of the factor into account.

The reason why it is necessary to insert the correction of the factor KT when the heating temperature is different from 1,200° C. is due to the facts that the rate of generating the δ ferrites depends on the temperature at the final heating, even if the contents of elements and the thermal history are the same.

EXAMPLES

In order to study the generation of the inside surface defects in a high Cr system seamless steel pipe which is produced by the method of the present invention, billets having the chemical components shown in Tables 1–3 were prepared. In these tables, the following is indicated: Specimen Nos. 1–28; 13% Cr steel, specimen Nos. 29–33; SUS 304 steel, specimen Nos. 34–38; SUS 316 steel, specimen Nos. 39–42; SUS 321 steel and specimen Nos. 44–48; SUS 347 steel.

TABLE 1

| Specimen | Chemical composition (mass %, residual Fe) | | | | | | | | | | | | | | | |
|---|---|---|---|---|---|---|---|---|---|---|---|---|---|---|---|---|
| No. | Cr | Si | Mo | V | Nb | Al | Ti | C | N | Cu | Ni | Mn | S | P | B | Ca |
| 1 | 13.15 | 0.26 | 0.01 | 0.04 | 0.001 | 0.001 | 0.002 | 0.18 | 0.029 | — | 0.10 | 0.50 | 0.018 | 0.016 | — | 0.0007 |
| 2 | 12.96 | 0.32 | — | 0.04 | 0.001 | 0.001 | 0.002 | 0.19 | 0.038 | 0.02 | 0.07 | 0.72 | 0.018 | 0.013 | 0.0001 | 0.0008 |
| 3 | 12.85 | 0.33 | — | 0.17 | — | 0.001 | 0.002 | 0.19 | 0.045 | — | 0.07 | 0.80 | 0.011 | 0.018 | 0.0003 | 0.0005 |
| 4 | 13.12 | 0.31 | — | 0.17 | — | 0.001 | 0.003 | 0.19 | 0.044 | — | 0.07 | 0.80 | 0.007 | 0.017 | — | 0.0001 |
| 5 | 12.81 | 0.29 | — | 0.17 | — | 0.001 | 0.002 | 0.20 | 0.043 | — | 0.07 | 0.62 | 0.008 | 0.018 | 0.0001 | — |
| 6 | 12.51 | 0.41 | — | 0.17 | — | 0.001 | 0.001 | 0.20 | 0.042 | 0.01 | 0.07 | 0.45 | 0.008 | 0.020 | 0.0003 | 0.0001 |
| 7 | 12.67 | 0.35 | 0.01 | 0.04 | 0.001 | 0.001 | 0.002 | 0.19 | 0.044 | 0.01 | 0.09 | 0.84 | 0.011 | 0.019 | — | — |

TABLE 1-continued

| Specimen | Chemical composition (mass %, residual Fe) | | | | | | | | | | | | | | | |
|---|---|---|---|---|---|---|---|---|---|---|---|---|---|---|---|---|
| No. | Cr | Si | Mo | V | Nb | Al | Ti | C | N | Cu | Ni | Mn | S | P | B | Ca |
| 8 | 12.47 | 0.36 | — | 0.17 | — | 0.001 | 0.002 | 0.20 | 0.043 | — | 0.07 | 0.81 | 0.008 | 0.009 | — | — |
| 9 | 12.62 | 0.24 | — | 0.18 | — | 0.001 | 0.001 | 0.20 | 0.039 | — | 0.07 | 0.90 | 0.004 | 0.018 | — | — |
| 10 | 12.74 | 0.24 | 0.01 | 0.04 | 0.002 | 0.001 | 0.001 | 0.20 | 0.040 | 0.01 | 0.11 | 0.87 | 0.008 | 0.012 | — | 0.0001 |
| 11 | 12.52 | 0.25 | — | 0.04 | 0.001 | 0.001 | 0.003 | 0.19 | 0.046 | — | 0.08 | 0.84 | 0.008 | 0.018 | — | — |
| 12 | 12.56 | 0.21 | — | 0.04 | 0.001 | 0.001 | 0.002 | 0.19 | 0.040 | — | 0.08 | 0.88 | 0.008 | 0.015 | — | — |
| 13 | 12.51 | 0.23 | — | 0.17 | — | 0.001 | 0.001 | 0.19 | 0.044 | — | 0.07 | 0.87 | 0.004 | 0.016 | — | — |
| 14 | 12.58 | 0.21 | — | 0.04 | 0.001 | 0.001 | 0.001 | 0.19 | 0.043 | — | 0.07 | 0.84 | 0.008 | 0.018 | — | — |
| 15 | 12.47 | 0.23 | — | 0.17 | — | 0.001 | 0.001 | 0.19 | 0.043 | — | 0.08 | 0.87 | 0.003 | 0.012 | — | — |
| 16 | 12.51 | 0.25 | — | 0.17 | — | 0.001 | 0.002 | 0.20 | 0.015 | — | 0.07 | 0.90 | 0.001 | 0.018 | — | 0.0002 |

TABLE 2

| Specimen | Chemical composition (mass %, residual Fe) | | | | | | | | | | | | | | | |
|---|---|---|---|---|---|---|---|---|---|---|---|---|---|---|---|---|
| No. | Cr | Si | Mo | V | Nb | Al | Ti | C | N | Cu | Ni | Mn | S | P | B | Ca |
| 17 | 12.50 | 0.23 | — | 0.17 | — | 0.001 | 0.003 | 0.20 | 0.043 | — | 0.07 | 0.80 | 0.003 | 0.015 | 0.0002 | — |
| 18 | 12.54 | 0.22 | — | 0.17 | — | 0.001 | 0.001 | 0.20 | 0.043 | — | 0.07 | 0.86 | 0.003 | 0.009 | — | — |
| 19 | 12.47 | 0.24 | — | 0.13 | — | 0.001 | 0.001 | 0.19 | 0.009 | — | 0.07 | 0.79 | 0.001 | 0.015 | — | 0.0001 |
| 20 | 12.49 | 0.23 | 0.01 | 0.04 | 0.001 | 0.001 | 0.002 | 0.19 | 0.042 | 0.01 | 0.13 | 0.86 | 0.003 | 0.010 | — | 0.0003 |
| 21 | 12.54 | 0.22 | — | 0.04 | 0.001 | 0.001 | 0.001 | 0.20 | 0.043 | — | 0.07 | 0.88 | 0.001 | 0.018 | — | — |
| 22 | 12.55 | 0.22 | — | 0.04 | 0.001 | 0.001 | 0.002 | 0.20 | 0.044 | — | 0.07 | 0.85 | 0.001 | 0.016 | — | — |
| 23 | 12.01 | 0.15 | 2.01 | 0.06 | 0.002 | 0.005 | 0.085 | 0.01 | 0.008 | 0.04 | 6.12 | 0.44 | 0.003 | 0.015 | — | — |
| 24 | 11.89 | 0.18 | 1.98 | 0.05 | 0.001 | 0.003 | 0.098 | 0.01 | 0.009 | 0.05 | 6.08 | 0.34 | 0.004 | 0.019 | — | — |
| 25 | 12.11 | 0.28 | 2.49 | 0.08 | 0.003 | 0.005 | 0.092 | 0.01 | 0.010 | 0.06 | 6.20 | 0.45 | 0.001 | 0.020 | — | — |
| 26 | 12.54 | 0.33 | 2.51 | 0.08 | 0.001 | 0.002 | 0.095 | 0.01 | 0.008 | 0.05 | 6.23 | 0.51 | 0.005 | 0.018 | — | — |
| 27 | 11.95 | 0.25 | 2.09 | 0.05 | 0.002 | 0.015 | 0.074 | 0.01 | 0.006 | 0.05 | 6.12 | 0.49 | 0.003 | 0.016 | — | — |
| 28 | 12.77 | 0.49 | 0.77 | 0.07 | 0.001 | 0.004 | 0.102 | 0.01 | 0.008 | 0.06 | 2.22 | 0.48 | 0.004 | 0.013 | — | — |
| 29 | 17.50 | 0.22 | 0.05 | 0.08 | 0.001 | 0.001 | 0.001 | 0.04 | 0.024 | 0.03 | 8.12 | 1.54 | 0.004 | 0.028 | — | — |
| 30 | 18.30 | 0.45 | 0.03 | 0.06 | 0.005 | 0.001 | 0.002 | 0.05 | 0.064 | 0.05 | 8.25 | 1.65 | 0.008 | 0.025 | — | 0.0001 |
| 31 | 19.10 | 0.48 | 0.02 | 0.09 | 0.008 | 0.001 | 0.003 | 0.03 | 0.035 | 0.04 | 8.01 | 1.28 | 0.003 | 0.021 | — | 0.0003 |
| 32 | 19.20 | 0.28 | 0.01 | 0.11 | 0.003 | 0.035 | 0.001 | 0.06 | 0.039 | 0.04 | 8.51 | 1.68 | 0.005 | 0.028 | — | — |

TABLE 3

| Specimen | Chemical composition (mass %, residual Fe) | | | | | | | | | | | | | | | |
|---|---|---|---|---|---|---|---|---|---|---|---|---|---|---|---|---|
| No. | Cr | Si | Mo | V | Nb | Al | Ti | C | N | Cu | Ni | Mn | S | P | B | Ca |
| 33 | 18.50 | 0.18 | 0.05 | 0.08 | 0.001 | 0.045 | 0.005 | 0.04 | 0.054 | 0.05 | 8.46 | 1.52 | 0.001 | 0.029 | — | 0.0026 |
| 34 | 17.60 | 0.22 | 2.11 | 0.15 | 0.001 | 0.041 | 0.002 | 0.03 | 0.082 | 0.02 | 11.51 | 1.35 | 0.001 | 0.029 | — | — |
| 35 | 17.80 | 0.45 | 2.25 | 0.11 | 0.002 | 0.036 | 0.001 | 0.04 | 0.095 | 0.05 | 10.55 | 1.88 | 0.002 | 0.023 | — | 0.0018 |
| 36 | 17.51 | 0.46 | 2.31 | 0.08 | — | — | 0.003 | 0.05 | 0.110 | 0.05 | 11.35 | 1.72 | 0.005 | 0.018 | — | — |
| 37 | 18.20 | 0.48 | 2.35 | 0.15 | 0.005 | 0.002 | 0.002 | 0.03 | 0.065 | 0.07 | 10.38 | 1.45 | 0.008 | 0.030 | 0.0002 | — |
| 38 | 19.10 | 0.25 | 2.02 | 0.11 | 0.008 | 0.001 | 0.001 | 0.04 | 0.066 | 0.06 | 10.98 | 1.75 | 0.003 | 0.028 | — | — |
| 39 | 17.70 | 0.24 | 0.01 | 0.11 | 0.002 | 0.001 | 0.345 | 0.04 | 0.012 | 0.06 | 9.31 | 1.61 | 0.005 | 0.026 | — | — |
| 40 | 19.15 | 0.29 | 0.03 | 0.12 | 0.001 | 0.005 | 0.353 | 0.05 | 0.008 | 0.05 | 9.05 | 1.35 | 0.003 | 0.027 | 0.0001 | — |
| 41 | 16.90 | 0.45 | 0.04 | 0.09 | 0.005 | 0.015 | 0.310 | 0.03 | 0.010 | 0.06 | 10.12 | 1.87 | 0.001 | 0.022 | — | 0.0003 |
| 42 | 18.11 | 0.33 | 0.04 | 0.07 | 0.003 | 0.001 | 0.289 | 0.08 | 0.008 | 0.03 | 9.43 | 1.77 | 0.007 | 0.023 | — | 0.0016 |
| 43 | 18.26 | 0.19 | 0.02 | 0.08 | 0.001 | 0.001 | 0.331 | 0.04 | 0.100 | 0.04 | 9.22 | 1.54 | 0.003 | 0.025 | — | 0.0003 |
| 44 | 17.88 | 0.21 | 0.03 | 0.10 | 0.729 | 0.002 | 0.003 | 0.06 | 0.042 | 0.07 | 11.34 | 1.41 | 0.001 | 0.028 | 0.0001 | 0.0002 |
| 45 | 18.85 | 0.42 | 0.02 | 0.10 | 0.915 | 0.005 | 0.002 | 0.04 | 0.044 | 0.06 | 11.48 | 1.64 | 0.002 | 0.024 | 0.0001 | 0.0011 |
| 46 | 19.51 | 0.31 | 0.02 | 0.12 | 0.884 | 0.003 | 0.003 | 0.06 | 0.052 | 0.05 | 12.05 | 1.69 | 0.002 | 0.021 | — | 0.0001 |
| 47 | 18.49 | 0.28 | 0.03 | 0.11 | 0.822 | 0.001 | 0.001 | 0.06 | 0.064 | 0.05 | 11.44 | 1.78 | 0.004 | 0.029 | — | 0.0002 |
| 48 | 19.12 | 0.36 | 0.03 | 0.13 | 0.867 | 0.015 | 0.002 | 0.05 | 0.091 | 0.06 | 11.51 | 1.70 | 0.002 | 0.022 | 0.0001 | 0.0002 |

These billets were used as primary material for producing the pipe, and heated for soaking in a heating furnace at a temperature of 1,100 to 1,300° C. Thereafter, the billets were pierced with a piercer to form hollow primary pipes, and subsequently rolled with a mandrel mill to form finished primary pipes for rolling. Finally, these finished primary pipes for rolling were re-heated at a temperature of 1,100° C., and after passing through a stretch reducer, seamless steel pipes having an outside diameter of 88.9 mm, an inside diameter of 70 mm and a length of 1,000 mm were produced.

The soaking period for the billet, i.e., Σt1, the soaking period for the primary pipe, i.e., Σt2 and the heating temperature in the process of producing the pipe T as conditions of manufacturing the bloom and pipe are listed in Tables 4–6. Moreover, the f values derived from the above equation (a) and the F values derived from the equations (b) and (c) are also listed in the Tables 4–6.

The steel pipes thus produced were hardened and annealed under predetermined conditions, and then the rate of generating the inside surface defects was inspected. The results of inspection are listed in the Tables 4–6.

TABLE 4

| Specimen No. | Conditions of manufacturing bloom and pipe: Bloom soaking period Σt1(Hr) | Billet soaking period Σt2(Hr) | Heating temperature T(° C.) | Calculated results: f value derived from equation (a) | F value derived from equations (b) and (c) | Rate of generating inside surface defects (%) |
|---|---|---|---|---|---|---|
| 1 | 1.00 | 0.50 | 1230.00 | −9.79 | −9.87 | 5.70 |
| 2 | 1.00 | 0.50 | 1260.00 | −9.67 | −10.06 | 4.20 |
| 3 | 2.00 | 1.00 | 1220.00 | −11.15 | −10.75 | 7.50 |
| 4 | 2.00 | 1.00 | 1220.00 | −11.02 | −10.63 | 5.20 |
| 5 | 2.00 | 1.50 | 1250.00 | −10.53 | −10.38 | 8.30 |
| 6 | 2.00 | 1.50 | 1200.00 | −11.43 | −10.29 | 6.20 |
| 7 | 2.00 | 1.00 | 1190.00 | −9.25 | −7.78 | 0.80 |
| 8 | 5.00 | 1.00 | 1180.00 | −10.77 | −9.05 | 1.50 |
| 9 | 6.00 | 1.50 | 1180.00 | −9.90 | −8.05 | 0.50 |
| 10 | 8.00 | 1.50 | 1230.00 | −8.00 | −7.54 | 0.80 |
| 11 | 4.00 | 1.00 | 1230.00 | −8.06 | −7.73 | 0.30 |
| 12 | 4.00 | 1.00 | 1230.00 | −7.82 | −7.49 | 0.95 |
| 13 | 5.00 | 1.00 | 1235.00 | −9.66 | −9.38 | 0.80 |
| 14 | 6.00 | 1.00 | 1220.00 | −7.80 | −7.32 | 0.26 |
| 15 | 6.00 | 1.00 | 1250.00 | −9.56 | −9.44 | 2.00 |
| 16 | 8.00 | 1.00 | 1220.00 | −10.23 | −9.75 | 1.10 |

TABLE 5

| Specimen No. | Conditions of manufacturing bloom and pipe: Bloom soaking period Σt1(Hr) | Billet soaking period Σt2(Hr) | Heating temperature T(° C.) | Calculated results: f value derived from equation (a) | F value derived from equations (b) and (c) | Rate of generating inside surface defects (%) |
|---|---|---|---|---|---|---|
| 17 | 4.50 | 1.00 | 1200.00 | −9.45 | −8.35 | 2.10 |
| 18 | 5.50 | 1.00 | 1240.00 | −9.33 | −9.11 | 1.80 |
| 19 | 5.00 | 1.00 | 1200.00 | −9.88 | −8.77 | 0.28 |
| 20 | 5.00 | 1.00 | 1200.00 | −7.62 | −6.51 | 0.40 |
| 21 | 4.00 | 1.00 | 1200.00 | −7.34 | −6.24 | 0.10 |
| 22 | 4.00 | 1.00 | 1180.00 | −7.31 | −5.59 | 0.10 |
| 23 | 3.00 | 1.00 | 1200,00 | −9.06 | −7.99 | 0.10 |
| 24 | 2.00 | 1.00 | 1250.00 | −9.27 | −9.24 | 0.10 |
| 25 | 4.00 | 2.00 | 1180.00 | −11.40 | −9.49 | 0.10 |
| 26 | 5.00 | 1.00 | 1180.00 | −12.41 | −10.68 | 3.30 |
| 27 | 3.00 | 1.00 | 1200.00 | −9.88 | −8.80 | 0.10 |
| 28 | 4.00 | 1.00 | 1180.00 | −15.25 | −13.53 | 6.70 |
| 29 | 4.50 | 1.50 | 1180.00 | −5.98 | −4.14 | — |
| 30 | 5.50 | 1.50 | 1180.00 | −7.12 | −5.27 | 0.50 |
| 31 | 1.00 | 1.00 | 1250,00 | −9.80 | −9.90 | 2.60 |
| 32 | 5.00 | 1.00 | 1200.00 | −7.00 | −5.90 | — |

TABLE 6

| Specimen No. | Conditions of manufacturing bloom and pipe: Bloom soaking period Σt1(Hr) | Billet soaking period Σt2(Hr) | Heating temperature T(° C.) | Calculated results: f value derived from equation (a) | F value derived from equations (b) and (c) | Rate of generating inside surface defects (%) |
|---|---|---|---|---|---|---|
| 33 | 4.00 | 1.00 | 1230.00 | −5.13 | −4.81 | 0.10 |
| 34 | 4.00 | 1.50 | 1200.00 | −5.84 | −4.63 | 0.30 |
| 35 | 6.00 | 2.00 | 1200.00 | −8.20 | −6.91 | 1.10 |
| 36 | 4.00 | 1.50 | 1180.00 | −6.37 | −4.53 | — |
| 37 | 4.00 | 1.50 | 1230.00 | −11.19 | −10.75 | 4.30 |
| 38 | 5.00 | 1.50 | 1180.00 | −7.34 | −5.50 | 0.40 |
| 39 | 3.00 | 1.00 | 1170.00 | −8.98 | −7.14 | — |
| 40 | 4.00 | 1.00 | 1220.00 | −11.06 | −10.59 | 5.20 |
| 41 | 4.50 | 1.50 | 1180.00 | −8.67 | −6.83 | 1.50 |
| 42 | 4.00 | 2.00 | 1200.00 | −8.25 | −6.96 | — |
| 43 | 3.50 | 2.00 | 1250.00 | −6.26 | −5.97 | 0.10 |
| 44 | 3.00 | 1.00 | 1220.00 | −5.97 | −5.52 | — |
| 45 | 2.00 | 1.00 | 1260.00 | −9.88 | −9.94 | 5.20 |
| 46 | 4.50 | 1.50 | 1220.00 | −8.23 | −7.65 | 1.50 |
| 47 | 4.00 | 2.00 | 1200.00 | −7.16 | −5.88 | — |
| 48 | 3.50 | 2.00 | 1250.00 | −8.30 | −8.02 | 0.10 |

FIG. 1 shows the relationship between the F value and the rate of generating the inside surface defects (%) in the high Cr system seamless steel pipes prepared in the embodiments. The rate of generating the inside surface defects (%) shown in FIG. 1 indicates the ratio of the number of finished pipes including one or more defects of inside scabs and/or inside small scabs to the total number of the inspected pipes.

From Tables 1–6 and the diagram in FIG. 1, it can be recognized that the manufacturing method according to the present invention provides high Cr system seamless steel pipes having a high inside surface quality, i.e., the rate of generating the inside surface defects being reduced to be not more than 2.0%, so long as the F value derived from the equations (b) and (c) is less than "−9.7", irrespective of the type of such a high Cr system steel as 13% Cr steel, SUS 304 steel, SUS 316 steel or the like.

Industrial Application

In accordance with the manufacturing method of the present invention, the generation of δ ferrites can sufficiently be suppressed in the process of producing the pipe in the hot working, thereby making it possible to produce a high Cr system seamless steel pipe having a reduced amount of inside surface defects, even when a high Cr steel is employed as a primary material for manufacturing the pipe. Since, moreover, a given productivity in producing the pipe can easily be attained, without any excessive addition of impurities in the material, high Cr system seamless steel pipe having a reduced amount of inside surface defects can be produced with a high efficiency and in a reduced production cost. Hence, the manufacturing method according to the present invention can be applied to a wide area in the field of producing seamless steel pipe.

What is claimed is:

1. A method for manufacturing a high Cr system seamless steel pipe, wherein an initial material including Cr at a content of 10 to 20 mass %, impurities S and P at respective contents of not more than 0.050 mass %, and one or more of C, Mn, Ni, N, Cu, Si, Mo, Ti, Nb and V and a balance of iron is heated for soaking at a temperature of not less than 1,100° C. for a total soaking period Σt1 (hours) to form a primary pipe material as a billet or bloom, and thereafter the primary pipe material is further heated for soaking at a temperature of not less than 1,100° C. for a total soaking period Σt2 (hours), and then heated at a temperature of 1,200° C. to form a finished pipe, wherein the soaking and/or the heating is carried out so as to fulfill the following equation (b), $$f=\{20\times C+0.3\times Mn+1.2\times Ni+25\times N+CU-9\times Si-0.8\times Cr-2\times Mo-10\times Ti-6\times Nb-15\times V\}-45\times(S+P/10) \quad (a)$$

$$F = f + 0.6\times\left(1-\frac{1}{e^{\Sigma t1}}\right) + 0.8\times\left(1-\frac{1}{e^{\Sigma t2}}\right) > -9.7 \quad (b)$$

where element symbols in the equation (a) represent the contents of the corresponding elements (mass %).

2. A method for manufacturing a high Cr system seamless steel pipe, wherein an initial material including Cr at a content of 10 to 20 mass %, impurities S and P at respective contents of not more than 0.050 mass %, and one or more of C, Mn, Ni, N, Cu, Si, Mo, Ti, Nb and V and a balance of iron is heated for soaking at a temperature of not less than 1,100° C. for a total soaking period Σt1 (hours) to form a primary pipe material as a billet or bloom, and thereafter the primary pipe material is further heated for soaking at a temperature of not less than 1,100° C. for a total period Σt2 (hours), and then heated at a temperature of 1,100 to 1,300° C. (except for 1,200° C.) to form a finished pipe, wherein the soaking and/or out so as to fulfill the following equation (c), $$f=\{20\times C+0.3\times Mn+1.2\times Ni+25\times N+CU-9\times Si-0.8\times Cr-2\times Mo-10\times Ti-6\times Nb-15\times V\}-45\times(S+P/10) \quad (a)$$

$$F = f + 0.6\times\left(1-\frac{1}{e^{\Sigma t1}}\right) + 0.8\times\left(1-\frac{1}{e^{\Sigma t2}}\right) + 1.4\times KT > -9.7 \quad (c)$$

where $$KT = \frac{1200-T}{\sqrt{|1200-T|}}$$

and element symbols in the equation (a) represent the contents of the corresponding elements (mass %)and the T symbol in equation (c) represents the temperature to form the pipe.

* * * * *

UNITED STATES PATENT AND TRADEMARK OFFICE

CERTIFICATE OF CORRECTION

PATENT NO. : 6,692,592 B2
DATED : February 17, 2004
INVENTOR(S) : Kidani et al.

It is certified that error appears in the above-identified patent and that said Letters Patent is hereby corrected as shown below:

Title page,
Item [57], ABSTRACT,
Line 11, "°C." should be -- °C --,

Column 1,
Line 47, "stabbing" should be -- slabbing --,
Line 62, "steal" should be -- steel --, Column 2,
Line 12, "°C." should be -- °C --, Column 3,
Lines 23, 27, 28, 47, 48 and 49, "°C." should be -- °C --, Column 7,
Lines 9, 14, 22, 29, 31 and 36, "°C." should be -- °C --, Column 8,
Line 16, "1-1/e(time t)" should be -- 1-1/$e^{(time\ t)}$" --,
Line 40, "°C." should be -- °C --, Column 9,
Line 64, "°C." should be -- °C --, Columns 11 and 12,
Tables 4, 5 and 6, 4$^{th}$ Column, "°C." should be -- °C --, Column 13,
Line 38, "Nb and V and a" should be -- Nb and V, and a --.

UNITED STATES PATENT AND TRADEMARK OFFICE

CERTIFICATE OF CORRECTION

PATENT NO. : 6,692,592 B2
DATED : February 17, 2004
INVENTOR(S) : Kidani et al.

It is certified that error appears in the above-identified patent and that said Letters Patent is hereby corrected as shown below:

Column 14,
Lines 1, 2, 20, 23, 24 and 25, "°C." should be -- °C --,
Lines 6 and 27, "CU" should be -- Cu --,
Line 26, "and/or out so as to" should be -- and/or the heating is carried out so as to --,
Line 38, "Nb and V and a" should be -- Nb and V, and a --.

Signed and Sealed this

Thirteenth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,692,592 B2
DATED : February 17, 2004
INVENTOR(S) : Kidani et al.

It is certified that error appears in the above-identified patent and that said Letters Patent is hereby corrected as shown below:

Title page,
Item [57], ABSTRACT,
Line 11, "°C." should be -- °C --,

Column 1,
Line 47, "stabbing" should be -- slabbing --,
Line 62, "steal" should be -- steel --, Column 2,
Line 12, "°C." should be -- °C --, Column 3,
Lines 23, 27, 28, 47, 48 and 49, "°C." should be -- °C --, Column 7,
Lines 9, 14, 22, 29, 31 and 36, "°C." should be -- °C --, Column 8,
Line 16, "1-1/e(time t)" should be -- 1-1/$e^{(time\ t)}$" --,
Line 40, "°C." should be -- °C --, Column 9,
Line 64, "°C." should be -- °C --, Columns 11 and 12,
Tables 4, 5 and 6, 4th Column, "°C." should be -- °C --, Column 13,
Line 38, "Nb and V and a" should be -- Nb and V, and a --.
Line 40, "°C." should be -- °C --.

UNITED STATES PATENT AND TRADEMARK OFFICE

CERTIFICATE OF CORRECTION

PATENT NO. : 6,692,592 B2
DATED : February 17, 2004
INVENTOR(S) : Kidani et al.

It is certified that error appears in the above-identified patent and that said Letters Patent is hereby corrected as shown below:

Column 14,
Lines 1, 2, 20, 23, 24 and 25, "°C." should be -- °C --,
Lines 6 and 27, "CU" should be -- Cu --,
Line 26, "and/or out so as to" should be -- and/or the heating is carried out so as to --,
Line 18, "Nb and V and a" should be -- Nb and V, and a --.

This certificate supersedes Certificate of Correction issued July 13, 2004.

Signed and Sealed this

Twenty-sixth Day of October, 2004

JON W. DUDAS
*Director of the United States Patent and Trademark Office*